US007770250B2

(12) United States Patent
Boresi et al.

(10) Patent No.: US 7,770,250 B2
(45) Date of Patent: Aug. 10, 2010

(54) FLARED LEG PRECAST CONCRETE BRIDGE SYSTEM

(75) Inventors: Glennon J. Boresi, Union, MO (US); Steven Michels, Libertyville, IL (US)

(73) Assignee: County Materials Corporation, Marathon, WI (US)

( * ) Notice: Subject to any disclaimer, the term of this patent is extended or adjusted under 35 U.S.C. 154(b) by 379 days.

(21) Appl. No.: 12/009,730

(22) Filed: Jan. 22, 2008

(65) Prior Publication Data

US 2009/0183321 A1 Jul. 23, 2009

(51) Int. Cl.
*E01D 4/00* (2006.01)
*E03F 1/00* (2006.01)

(52) U.S. Cl. ..... 14/24; 405/124; 405/126

(58) Field of Classification Search ..... 14/24; 405/124, 126

See application file for complete search history.

(56) References Cited

U.S. PATENT DOCUMENTS

| | | | |
|---|---|---|---|
| 3,999,394 | A | 12/1976 | Eberhardt et al. |
| 4,073,148 | A | 2/1978 | Zaretti |
| 4,314,775 | A | 2/1982 | Johnson |
| 4,595,314 | A | 6/1986 | Lockwood |
| 4,687,371 | A | 8/1987 | Lockwood |
| 4,797,030 | A | 1/1989 | Lockwood |
| 4,854,775 | A | 8/1989 | Lockwood |
| 4,993,872 | A | 2/1991 | Lockwood |
| 5,199,819 | A | 4/1993 | Matiere |
| D356,163 | S | 3/1995 | Ryan |
| D406,902 | S | 3/1999 | Lockwood |
| 5,890,838 | A | 4/1999 | Moore, Jr. et al. |
| 6,401,286 | B1 | 6/2002 | Brenn |
| D484,610 | S | 12/2003 | Lockwood |
| 6,719,492 | B1 | 4/2004 | Heierli |
| D490,533 | S | 5/2004 | Lockwood |
| 6,854,928 | B2 | 2/2005 | Lockwood |
| 6,922,950 | B2 | 8/2005 | Heierli |
| D511,387 | S | 11/2005 | Beach |
| 6,962,465 | B2 | 11/2005 | Zax et al. |
| D512,513 | S | 12/2005 | Wasniak et al. |
| D514,706 | S | 2/2006 | Beach |
| 7,001,110 | B2 | 2/2006 | Lockwood |
| 2006/0201091 | A1 | 9/2006 | Lockwood |
| 2007/0059102 | A1 | 3/2007 | Beach et al. |
| 2007/0098503 | A1 | 5/2007 | Vaia |

FOREIGN PATENT DOCUMENTS

| | | |
|---|---|---|
| JP | 2006219848 | 8/2006 |

*Primary Examiner*—Raymond W Addie
(74) *Attorney, Agent, or Firm*—Michael Best & Friedrich LLP

(57) ABSTRACT

A concrete building system includes a set of parallel spaced apart strip footers and one or more precast concrete sections supported by the footers in a predetermined alignment. Each precast concrete section has a top slab integrally connected to a pair of equally flared legs. Each leg depends from an end of the top slab at an effective flare angle to form a corner. The precast section includes haunch sections formed between the top slab and each leg resulting in a corner thickness greater than the uniform thickness of the angled leg to which it is integrally formed and the top member. The length of the effective span of each section varies between 60 and 90 percent of the distance between the bottom-of-leg span. The sections can be used to construct bridges, culverts, underground storage units, fluid detention units and dam structures.

22 Claims, 11 Drawing Sheets

FLARED LEG PRECAST CONCRETE BRIDGE SYSTEM

CROSS REFERENCE TO RELATED APPLICATION

Not applicable.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to precast concrete structures and more particularly to precast concrete bridge and culvert units.

BACKGROUND OF THE INVENTION

It is known in the art to use precast concrete building systems in the construction of culverts and bridges. The structures built according to these systems are composed of one or more elemental sections successively placed adjacent to one another. In this regard the individual sections are placed side-by-side in the ground to form, for example, a bridge beneath traffic-ways for road-over-road or road-over-stream crossings. The elemental sections can also be used to construct culverts and underground storage vaults. By precasting multiple sections offsite for subsequent erection onsite, overall project construction time can be compressed as compared to cast-in-place concrete structures. Also, due to the improved quality control associated with facility manufacturing, the end-product structure provides greater inherent durability over that of a cast-in-place concrete structure. Bridges, culverts and underground storage structures can be made from the same elemental sections. Accordingly, in this application the word "bridge" or "bridge assembly" is defined to include a culvert or underground storage structure, unless otherwise indicated.

There are two basic varieties of prior art precast bridge systems: flattop and arched-top. FIGS. 1*a* and 1*b* respectively depict the elemental sections of these prior art systems. As seen in FIGS. 1*a* and 1*b*, both the flattop and arched-top section comprise a structural top member 2 integrally connected to and abridging two spaced-apart legs 4. The arched-top bridge section of FIG. 1*b* is considered by many to be esthetically more pleasing than the flattop section of FIG. 1*a*. On the other hand, the existing flattop system beneficially maximizes waterway area for water flow of streams and creeks. Structurally, however, the arched-top bridge system is generally more efficient than the flattop systems. The arched-topped section has the ability to carry vertical loads through arching. This arching creates significant outward horizontal thrust in the legs that results in a structure highly dependent on the support of adjacent backfill. By comparison, the prior art flattop bridge sections have higher bending moments and no arching. The flattop section is less dependent on the support of adjacent backfill for structural integrity. However, both the prior art flattop and arched-top bridge systems derive a significant degree of their structural capacity from the support provided by backfill material and are thus susceptible to foundation movements and shifting because of poorly placed backfill. Also, in the case of the arched-top system, in order to manufacture a wide range of spans and rises, a manufacturer must have several different sets of concrete forms on hand. These forms are expensive to manufacture and difficult to use in a production driven environment.

SUMMARY OF THE INVENTION

The present invention is directed to a precast concrete system that addresses the disadvantages and deficits of the prior art flattop and arched-top bridge systems. In this regard, the present invention is directed to a precast concrete bridge system comprising precast sections that include a flat top slab integrally abridging two angled legs. As used in this application the words "angled," "angular" or "angularly" with reference to legs mean sloped or inclined and not substantially vertical or normal to the horizontal. The invention disclosed herein provides the desirable features of precast reinforced concrete structures but with lower bending moments than the prior art flattop bridge section and less horizontal thrust than the prior art arched-top bridge section. While achieving these advantages, the top slab of the present invention bridge system provides for a reduced horizontal effective span dimension as compared with the prior art bridge sections. Additionally, the combination of elemental section geometry with properly placed and compacted select backfill provides an efficient use of materials to carry vertical loads across the span.

The concrete building system of the present invention comprises a set of parallel spaced apart strip footers and one or more precast concrete sections supported by the footers in predetermined alignment. The footers may be established at identical or differing elevations. The horizontal distance between the leg bottoms defines a bottom-of-leg span. Each precast concrete section has a top slab integrally connected to a pair of flared legs, which in the preferred embodiment are equally flared. The top slab has a uniform thickness, an inner surface, an upper surface, a first end and a second end. The horizontal distance between the first end and the second end of the top slab defines an effective span. Each leg has a length, a uniform thickness, an inner surface, an outer surface, a top portion and a bottom portion. The bottom portion of the leg is supported by a footer. Critically, each leg depends from the top slab at an effective flare angle (as measured from the horizontal) to form a corner. Each precast concrete section includes a pair of haunch sections integrally formed between the top slab and the legs. Specifically, each haunch section extends from the inner surface of the top slab near its end to the inner surface of the top portion of the leg adjacent to that top slab end. The integral haunch section results in a localized corner thickness substantially greater than the uniform thickness of the angled legs and top member. The section has a rise defined by the vertical distance between the bottom of the lowermost leg and the inner surface of the top slab.

The effective span has a practical dimension length of between 60 and 90 percent of the bottom-of-leg span and a preferred length of between 75 and 85 percent of the bottom-of-leg span. The effective flare angle of one or more of the depending legs can vary between a practical range of 55 to 85 degrees depending upon span. For short span embodiments, the elemental precast section can have an effective flare angle of practically between 75 and 85 degrees, more preferably between 79 and 82 degrees and most preferably between 80 and 81 degrees. For long span embodiments, the elemental section can have an effective flare angle of practically between 55 and 80 degrees, more preferably between 65 and 75 degrees and most preferably between 71 and 72 degrees. When utilizing these ranges, the concrete building system of the present invention can effectively accommodate structural rises of between 6 and 14 feet and bottom-of-leg span distances between 12 and 48 feet, depending upon effective flare angle and the thickness of the legs and top slab. Additionally, each haunch section can be constructed to preferably include an arcuate inner surface having a radius. In preferred embodiment systems, the haunch radius varies between 24 to 36 inches depending upon chosen bottom-of-leg span. The present invention bridge system includes integral reinforcing members for added strength. As with conventional precast bridge systems, the present invention system can also be used as a culvert structure or underground storage vault. However, unlike other precast bridge systems the present invention bridge system can also be used as a dam structure or flow control device.

Effective flare angles, spans and rises can be individually adjusted to accommodate a wide range of waterway cross sectional dimensions, flow paths and volume-of-flow requirements. The unique geometric shape of the system reduces the resulting structure's effective span at the top of the structure by sixty to ninety percent as compared to prior art systems. The angular legs reduce the bending moments developed in the structure, but still realize the contributory benefits from the lateral soil support provided by the surrounding soil without being highly dependent upon it.

The forming system for the elemental units of the present invention bridge system economizes the number of forms needed to produce the desired range of spans and rises and minimizes production set-up and stripping (form removal) time. The system also accommodates a wide range of panelized or modular retaining wall systems needed to contain earthen fill above and adjacent to the end sections and smoothly redirects stream flow through the completed system. Other features and advantages of the invention will be apparent from the following description and accompanying drawings.

DESCRIPTION OF THE PREFERRED EMBODIMENTS

Figures 1A, 1B:
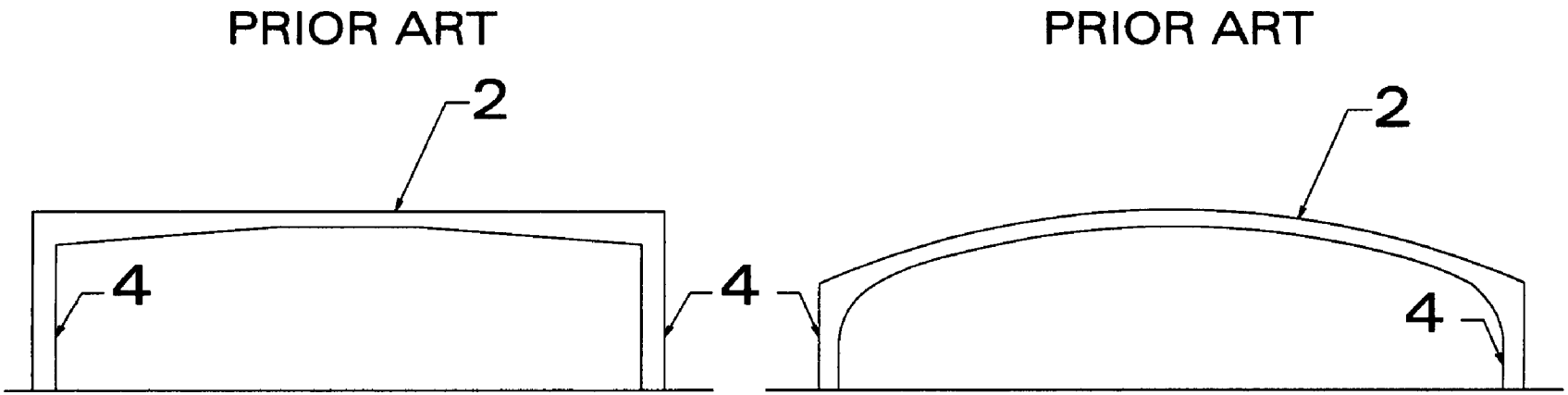
FIG. 1*a* is a front elevation view of the elemental section of the prior art flattop bridge system.
FIG. 1*b* is a front elevation view of the elemental section of the prior art arched-top bridge system.
Figure 2:
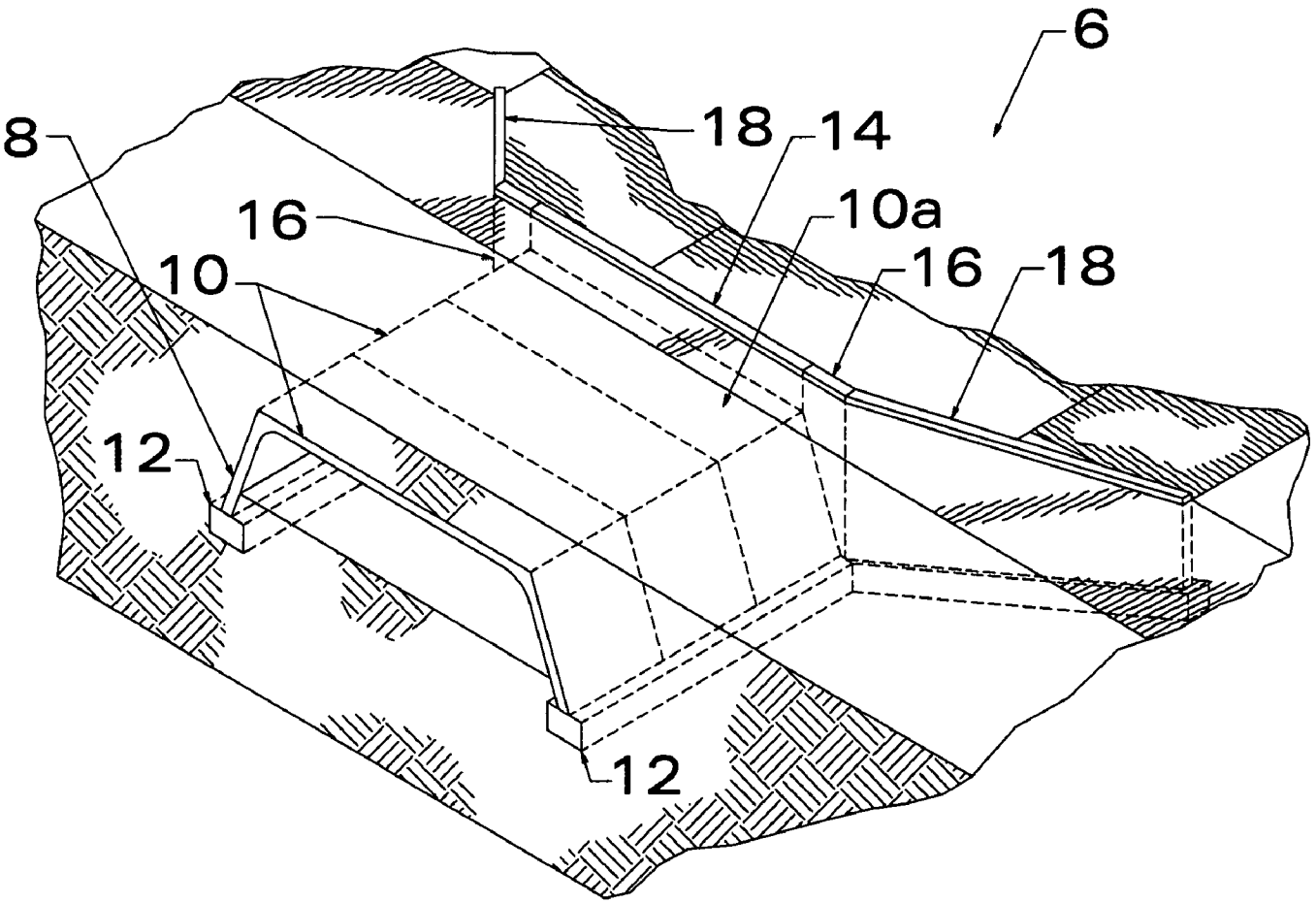
FIG. 2 is a phantom perspective view of a bridge assembly used in a road-over-stream application and comprising multiple precast sections of the present invention.
Figure 3:
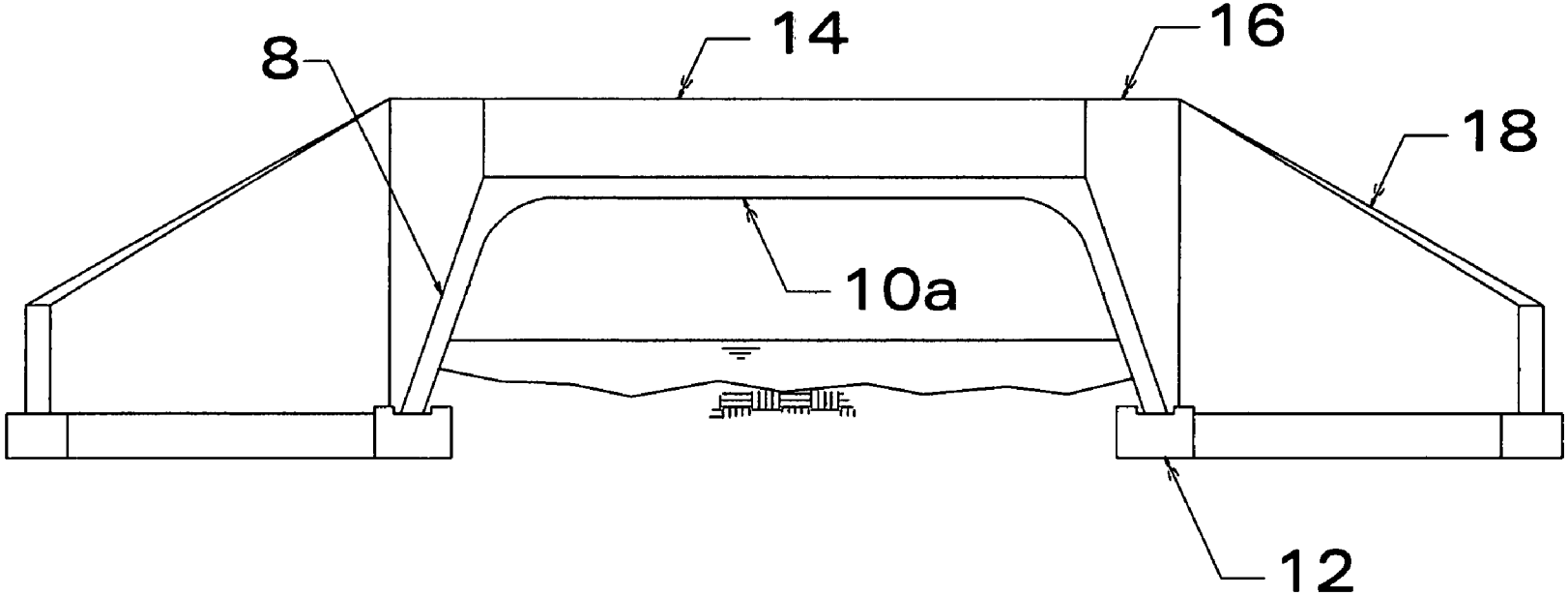
FIG. 3 is an elevation view of the rear of the bridge assembly of FIG. 2 depicting end section 10*a* with adjoining head wall, sidewalls and wing walls.
Figure 4:
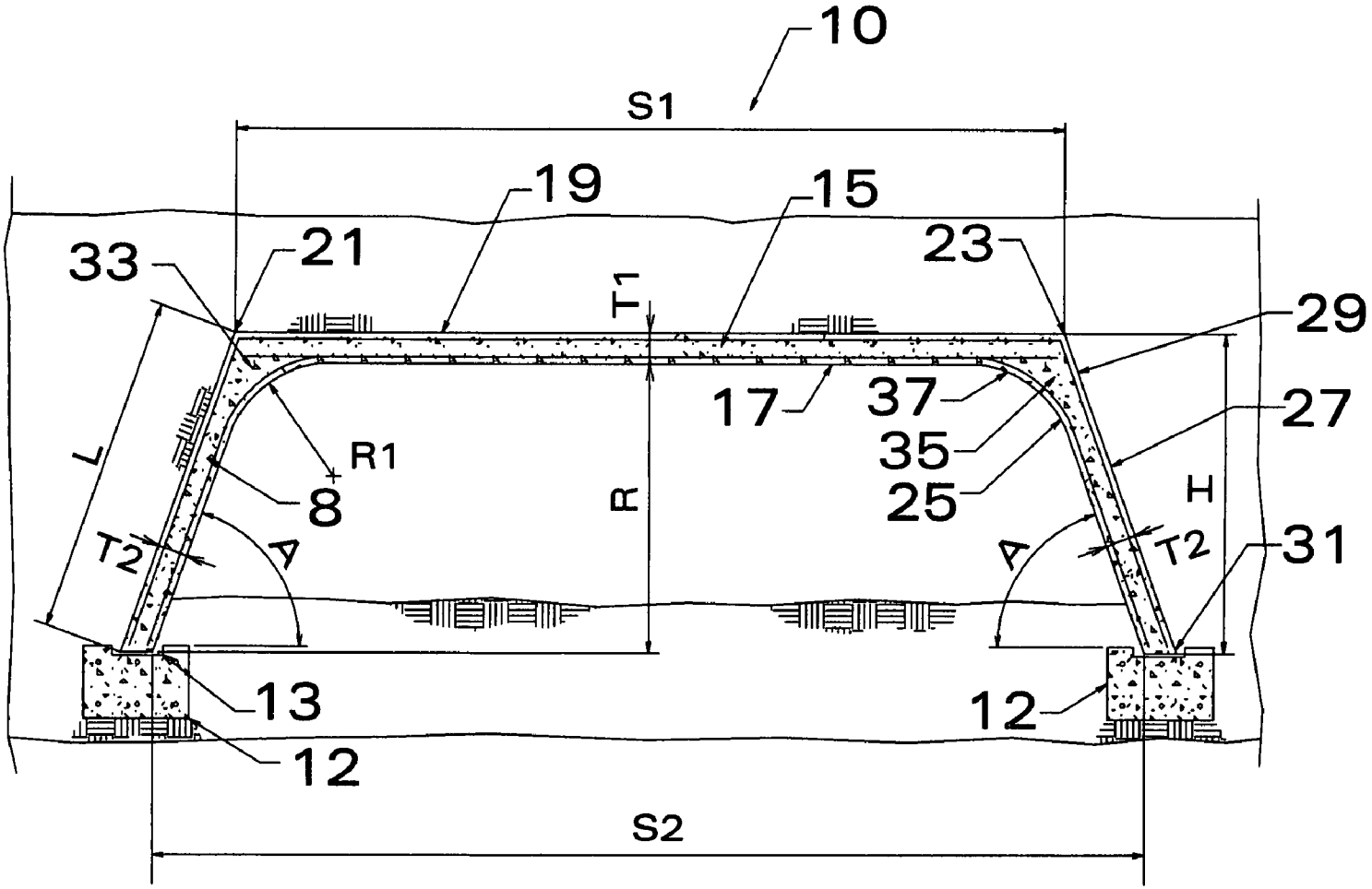
FIG. 4 is a cross section view of a preferred embodiment section of the present invention system taken along line X-X of FIG. 5.
Figure 5:
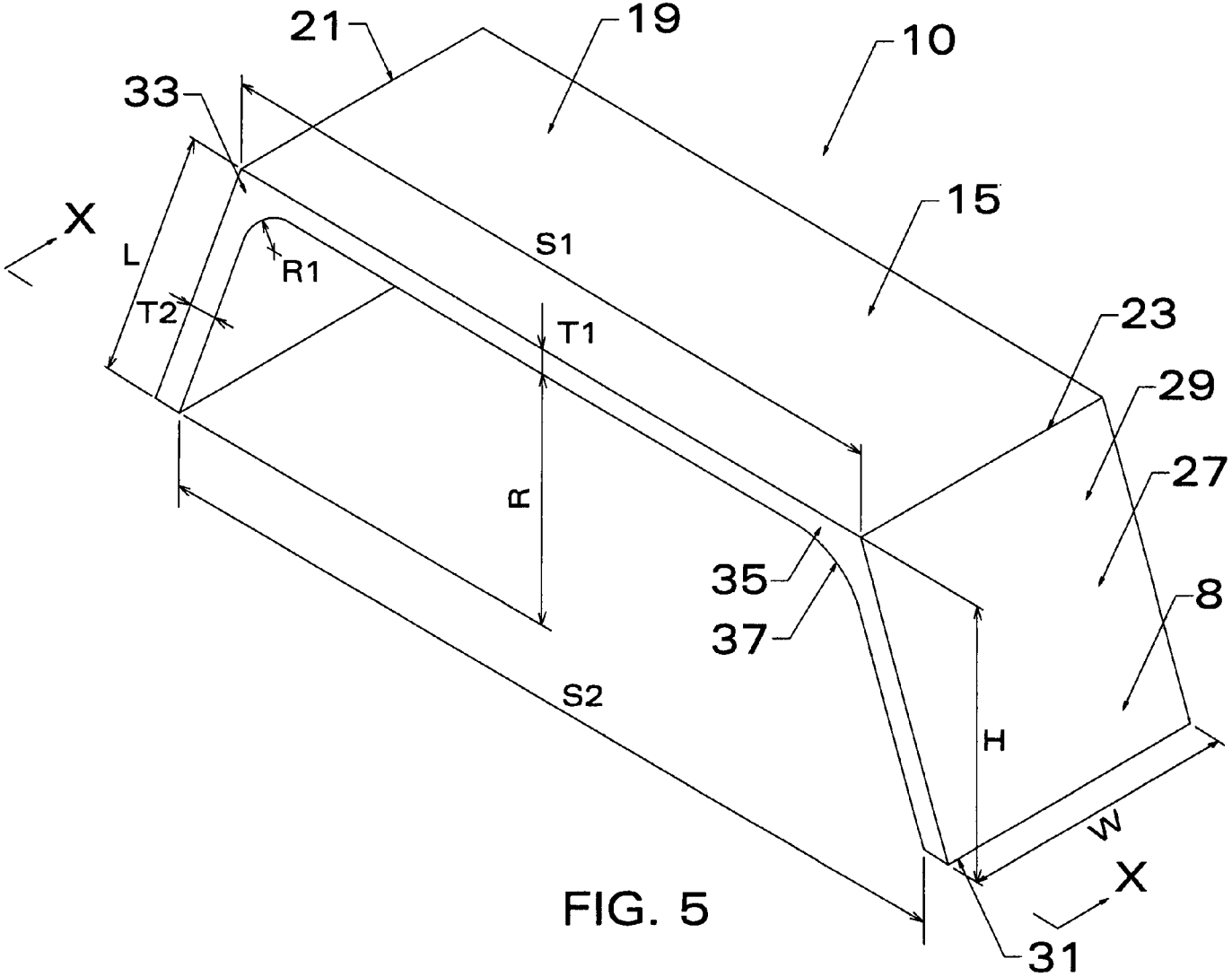
FIG. 5 is a perspective view of a preferred embodiment section of the present invention.
Figure 6:
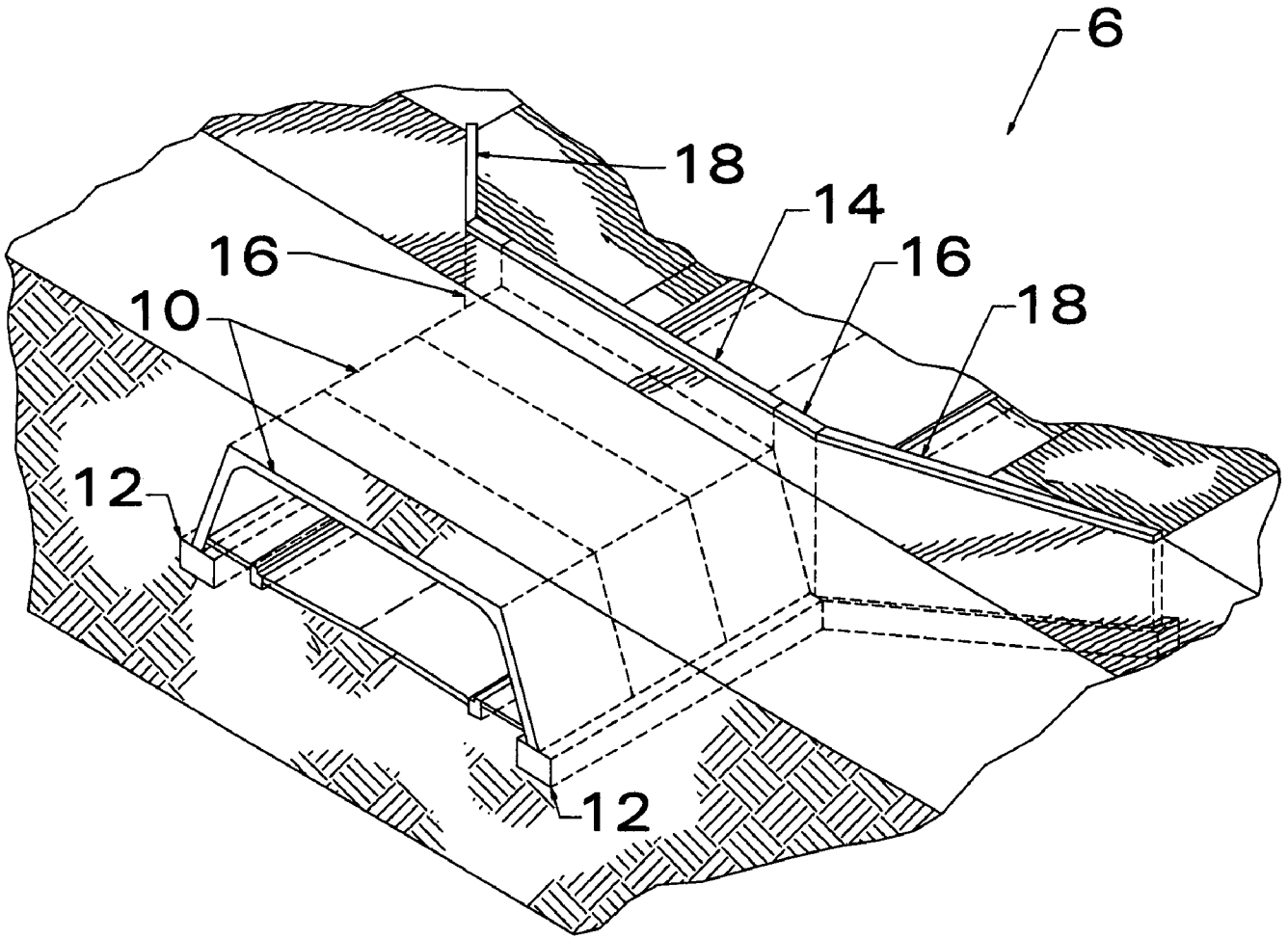
FIG. 6 is a phantom perspective view of an embodiment of the present invention system in a road-over-road application (tunnel) that can be used for vehicular or pedestrian traffic.

FIGS. 2, 6 illustrate a preferred embodiment bridge assembly 6 constructed by way of the present invention system. FIGS. 3, 4 and 5 depict preferred embodiment precast sections used in the construction of bridge assembly 6. As shown by these figures, bridge 6 comprises a series of precast elemental concrete sections 10 that are placed in face-to-face parallel alignment. The leg members 8 of each section sit atop two parallel, continuous concrete strip footers 12 that are formed in trenches and cast into the ground. As shown in FIG. 4 concrete strip footer 12 is cast with recess 13 that is sized to receive bottom portion 31 of leg 8. After placement, leg 8 is locked in-place onto footer 12 with cementitious grout. Depending upon site characteristics or other requirements, strip footers 12 may be connected by a cast-in-place concrete slab (not shown).

As shown in FIG. 4, legs 8 depend angularly from top slab 15 at an effective flare angle A as measured from the horizontal. In a preferred embodiment, the effective flare angle A of both legs 8 is equal. However, effective flare angle A can be varied as between legs 8 to accommodate site topography. Top slab 15 includes uniform thickness T1, an inner surface 17 an upper (outer) surface 19, a first end 21 and a second end 23. The horizontal distance between first end 21 and second end 23 defines an effective span S1. Leg 8 has a length L, a uniform thickness T2, an inner surface 25, an outer surface 27, a top portion 29 and a bottom portion 31. Bottom portion 31 of the leg is supported by footer 12. The horizontal distance between the inner surfaces 25 of bottom portions 31 of legs 8 defines a bottom-of-leg span S2.

Each leg depends angularly from an end 21, 23 of the top slab at an effective flare angle A (as measured from the horizontal) to form a corner 33. The elemental precast concrete section of the present invention includes a pair of haunch sections 35, each integrally formed between top slab 15 and legs 8 at corners 33. Specifically, each haunch section 35 extends from inner surface 17 of top slab 15 near an end 21, 23 to inner surface 25 of top portion 29 of the leg 8 nearest that top slab end. Integral haunch section 35 results in a corner thickness greater than the uniform thicknesses T1, T2 of the top slab and the angled leg to which it is integrally formed. The elemental section has a rise R defined by the vertical distance between the elevation of bottom portion 31 and the elevation of inner surface 17 of top slab 15.

As is best shown in FIG. 3, in a preferred embodiment end section 10*a* is manufactured with integrally attached headwall 14 to contain soil fill on top of the bridge assembly 6. Alternatively, head wall 14 may be independently cast and then mechanically connected to end section 10*a*. Precast concrete sidewall 16 may be integrally cast onto angled legs 8 or independently cast and then mechanically connected to angled leg 8. Wingwall 18 extends upward from top of footer 12 to meet the elevation of the top of headwall 14. Sidewalls 16 provide for a convenient connection to wingwalls 18, which can be either precast or cast-in-place concrete, and extend outwardly at various horizontal angles to define an entrance and exit for water flowing in the channel formed within the soil.

During installation of the disclosed bridge system, sections 10 abut one another in face-to-face alignment and are temporarily held in-place by the strip footer keyways and blocking. Subsequent to grouting of the keyways, sections 10 are backfilled and covered with compacted soil. As installed, sections 10 can support a roadbed or roadway pavement on top of the assembled bridge system. The roadway can cross the bridge assembly at any angle relative to the longitudinal axis of the assembly.

Top slab 15 and angular legs 8 are flat and of respective uniform thickness T1 and T2, except at the haunches 35. In the embodiments discussed herein, the thickness of angled legs 8 and top slab 15 will range between eight inches and fourteen inches, inclusive. Haunches 35 are thickened for strength and include inner surface 37. In the preferred embodiment, inner surface 37 is concavely arcuate in form such that inner surface 17 of top slab 15 smoothly curves into connection with inner surface 25 of angled leg 8. Arcuately formed haunch section 35 has a radius R1, which can vary practically between eight and forty-two inches depending on the length of bottom-of-leg span dimension S2.

As shown in FIG. 4, the overall height H of elemental section 10 is equal to the sum of rise R and top slab thickness T1. Rise dimension R can range from about four feet to fourteen feet. The effective span S1 will range between 60 and 90 percent of the bottom-of-leg span dimension S2. The preferred effective span range is between 75 and 85 percent of the bottom-of-leg span. The width W of section 10 may range between about four feet and ten feet, depending upon the bottom-of-leg span, and is preferably between six to eight feet for most spans.

The concrete of precast section 10 is reinforced in the conventional manner. Such reinforcement may include a grid of crossing steel reinforcing rods, mesh or members embedded within angular legs 8 and flat top slab 15. Such reinforcing rods, mesh or members are situated relatively close to both outer surfaces 19, 27 and inner surfaces, 17, 25. The reinforcing rods form grids that significantly increase the load carrying strength of precast section 10 enabling it to handle heavy loads or traffic on pavement above. Legs 8 and top slab 15 may include embedded tendons in place of or in addition to the steel grids. These tendons may be pre- or post-tensioned. Legs 8 and top slab 15 may include in place of or in addition to the above reinforcement features, mixed-in steel fibers (fiber mesh) to enhance overall durability and capacity for external loading.

For practical application purposes, the embodiment sections of the present invention precast bridge system can be categorized into short span embodiments and long span embodiments. Elemental sections of the short span embodiment have a bottom-of-leg span dimension S2 that ranges from 12 feet to 22 feet and a rise dimension R that ranges from 6 feet to 14 feet. The elemental section of short span embodiment can have an effective flare angle of practically between 75 and 85 degrees, more preferably between 79 and 82 degrees and most preferably between 80 and 81 degrees. The elemental section of the short span embodiment can have a haunch radius of practically between 8 and 42 inches, more preferably between 18 and 33 inches and most preferably between 23 and 25 inches. The haunch radius of the preferred short span embodiment is 24 inches.

The short span embodiment section can be further subdivided for general application purposes into two groups, each with a different leg and flat top thickness. For embodiment sections with a bottom-of-leg span dimension of 12 feet to 18 feet, the uniform thickness of the legs and top slab may be as thin as 8 inches. Thus, one short span series embodiment could have the following dimensions: a uniform thickness of the top slab of no greater than 8 inches, a uniform thickness of each leg of no greater than 8 inches, a bottom-of-leg span of at least 12 feet and a rise of at least 6 feet. For units with bottom-of-leg span dimensions of 18 to 22 feet, the uniform thickness of the legs and top slab is preferably 10 inches, but may also be as little as 8 inches. The effective span to bottom-of-leg span ratio for the short span series can vary between 0.6 to 0.9, with the preferred ratio being between 0.75 to 0.85.

Elemental sections of the long span embodiment have a bottom-of-leg span dimension S2 that ranges from 22 feet to 48 feet and a rise dimension R that ranges from 6 feet to 14 feet. The elemental section of long span embodiment can have an effective flare angle of practically between 55 and 80 degrees, more preferably between 65 and 75 degrees and most preferably between 71 and 72 degrees. The elemental section of the long span embodiment can have a haunch radius of practically between 10 and 42 inches, more preferably between 24 and 42 inches and most preferably between 35 and 37 inches. The haunch radius of the preferred long span embodiment is 36 inches. The long span embodiment section can be further sub-divided for general application purposes into two groups, each with a different leg and flat top thickness. For embodiment sections with a bottom-of-leg span dimension of 22 feet to 40 feet, the uniform thickness of the legs and top slab may be as thin as 12 inches. Hence, one long span series embodiment could have the following dimensions: a uniform thickness of the top slab of no greater than 12 inches, a uniform thickness of each leg of no greater than 12 inches, a bottom-of-leg span of at least 22 feet and a rise of at least 6 feet. For units with bottom-of-leg span dimensions of 40 to 48 feet, the thickness of the legs and top slab may be as thin as 14 inches. Hence, another long span series embodiment could have the following dimensions: a uniform thickness of the top slab of no greater than 14 inches, a uniform thickness of each leg of no greater than 14 inches, a bottom-of-leg span of at least 40 feet and a rise of at least 6 feet. The effective span to bottom-of-leg span ratio for the long span series can vary between 0.6 to 0.9, with a preferred ratio between 0.75 and 0.85.

The flared leg precast bridge system of the present invention provides advantages over the prior art flattop and arched-top systems. Specifically, the above described values and relationships between effective flare angle and effective span dimension provide an optimum configuration for reducing bending moment and horizontal thrust effects that result from earth or ground (i.e., dead) loads as well as vehicular traffic (i.e., live) loads on the top slab. As compared to prior art systems, the top slab of the present invention system has a reduced effective span dimension. Additionally, all continuous buried structures benefit from soil-structure interaction (SSI). The geometry of the precast elemental sections of the present invention make effective use of the SSI that takes place between the structure and the surrounding soil mass. SSI utilizes the lateral or horizontal forces acting against the legs to aid in supporting the earth or ground and other loads on the top slab. In addition, the angular legs provide a convenient means to connect the sidewalls and vertical wingwalls in such a way as to produce a smooth flow of water into and out of the bridge system formed by multiple sections placed face-to-face.

Figure 7:
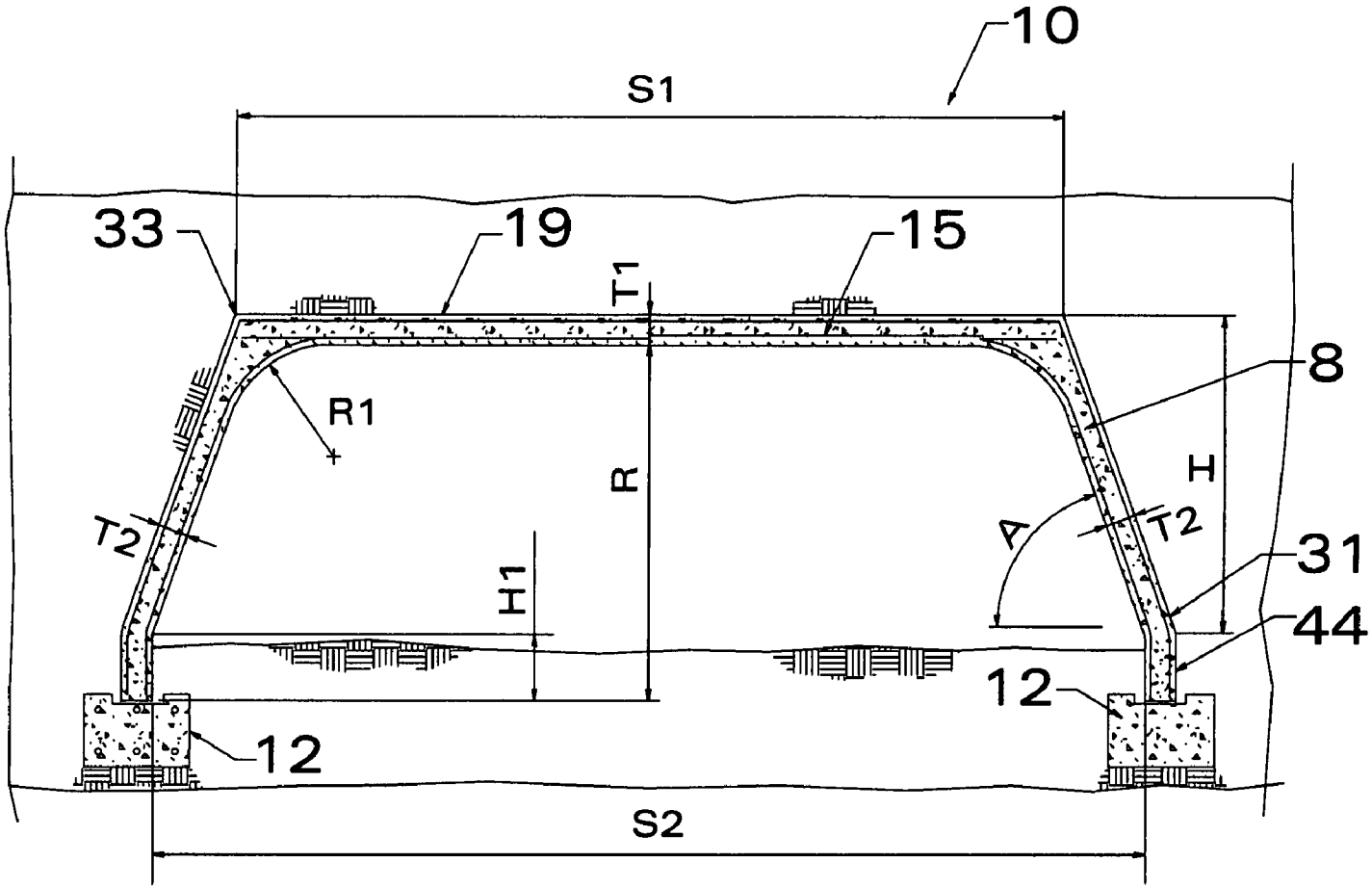
FIG. 7 is a cut-in-half cross section view of an alternative embodiment section of the present invention system with integral vertical leg extensions.

Production of the system sections can be efficiently completed using metal forms situated on-end (i.e., forms are filled vertically in the direction of section width W). This type of form design allows for a convenient means to vary leg angle, rise and span. The section span lengths and rise heights can be conveniently varied by adding or removing straight form segments along the top slab or angled legs. Additional changes in section span and rise length can also be conveniently made by simply repositioning bulkheads located at the bottom-of-leg portion of the form. As shown in FIG. 7, section rise R can be increased by adding inwardly-angled (vertical) extensions of height H1 to the bottom portion 31 of legs 8. In this embodiment, legs 8 of precast section 10 include integral depending leg extensions 44. By including leg extensions on the elemental sections, the sections can be easily tailored to meet the needs of nearly any site-specific application.

Figure 8:
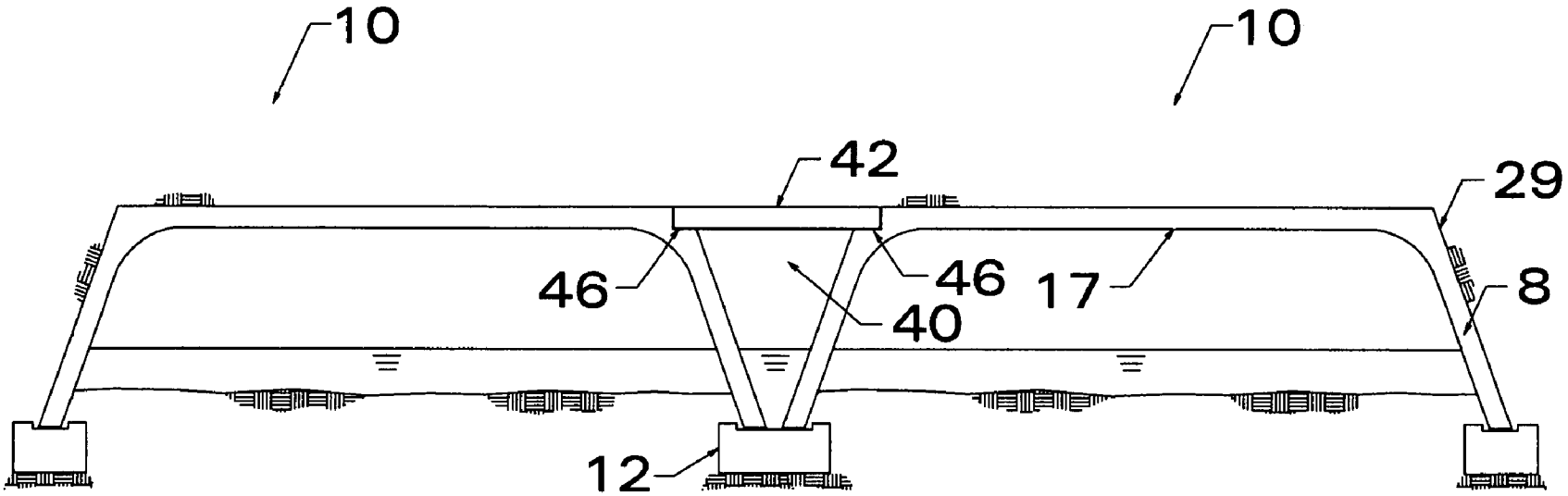
FIG. 8 is an elevation view of abridged preferred embodiment sections of the present invention placed end-to-end in a road-over-stream application or a multi-celled underground fluid storage tank.

Referring to FIG. 8, two precast sections 10 are arranged in an end-to-end configuration on corresponding continuous concrete strip footers 12. The angular or filleted space 40 between the adjoining angled legs of the sections is closed on top by a separate precast concrete panel 42, which panel may be partially reinforced with mild steel reinforcement, prestressing strand pre-tensioned before the casting process or a combination of both. Panel 42 is set into recesses or benches 46 that are formed into the top portions 29 of legs 8. This embodiment assembly of the precast sections and flat panels is ideally suited for forming a multi-spanned stream crossing. In this application, the filleted space can be expanded with a wider central strip footer and longer spanned precast or prestressed panels to gain increased waterway area without the addition of an additional line of precast sections. Further, one line of precast sections can be manufactured with a shorter rise than the other line to provide for a main channel and a separate, higher elevation overflow channel.

As with other prior art systems, the precast sections of the present invention system are ideally suited for construction of underground storage or retention tanks. Similarly, the precast sections of the present invention system may be manufactured with one leg width W of the section narrower than the opposite leg width, thus creating a wedge-shaped (tapered) section to produce a curved assembly.

Figure 9:
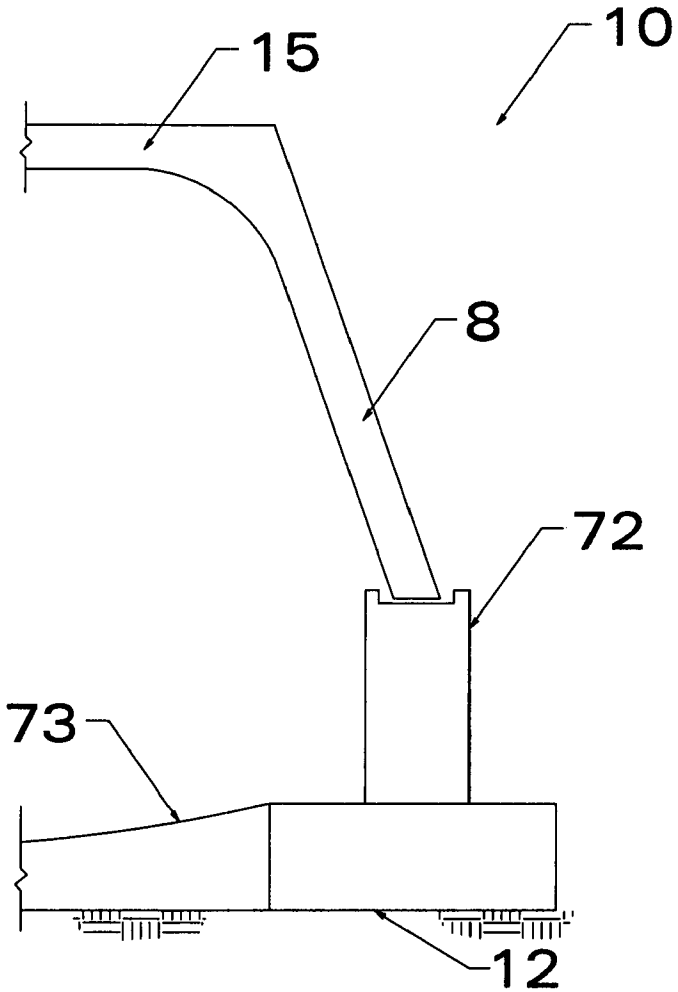
FIG. 9 is a partial elevation view of a bridge unit of the present invention supported upon a pedestal wall.

Referring to FIG. 9, certain applications may require a rise or height that is beyond normal precast shipping restrictions, or the cost of the additional right-of-way for a wider multi-spanned arrangement is cost prohibitive. In these cases, the precast sections of the present invention system can be installed on cast-in-place concrete pedestal walls that add vertical height and associated waterway area to the cross section without adding an additional line of precast sections to the assembly. FIG. 9 is a partial elevation view of a bridge unit of the present invention supported upon pedestal wall 72 in a situation requiring the overall rise to be greater than what can be practically shipped. Pedestal wall 72 is integrally formed to concrete strip footers 12 or an appropriately sloped and reinforced concrete base slab 73 that supports both the pedestals and the precast section.

Figure 10:
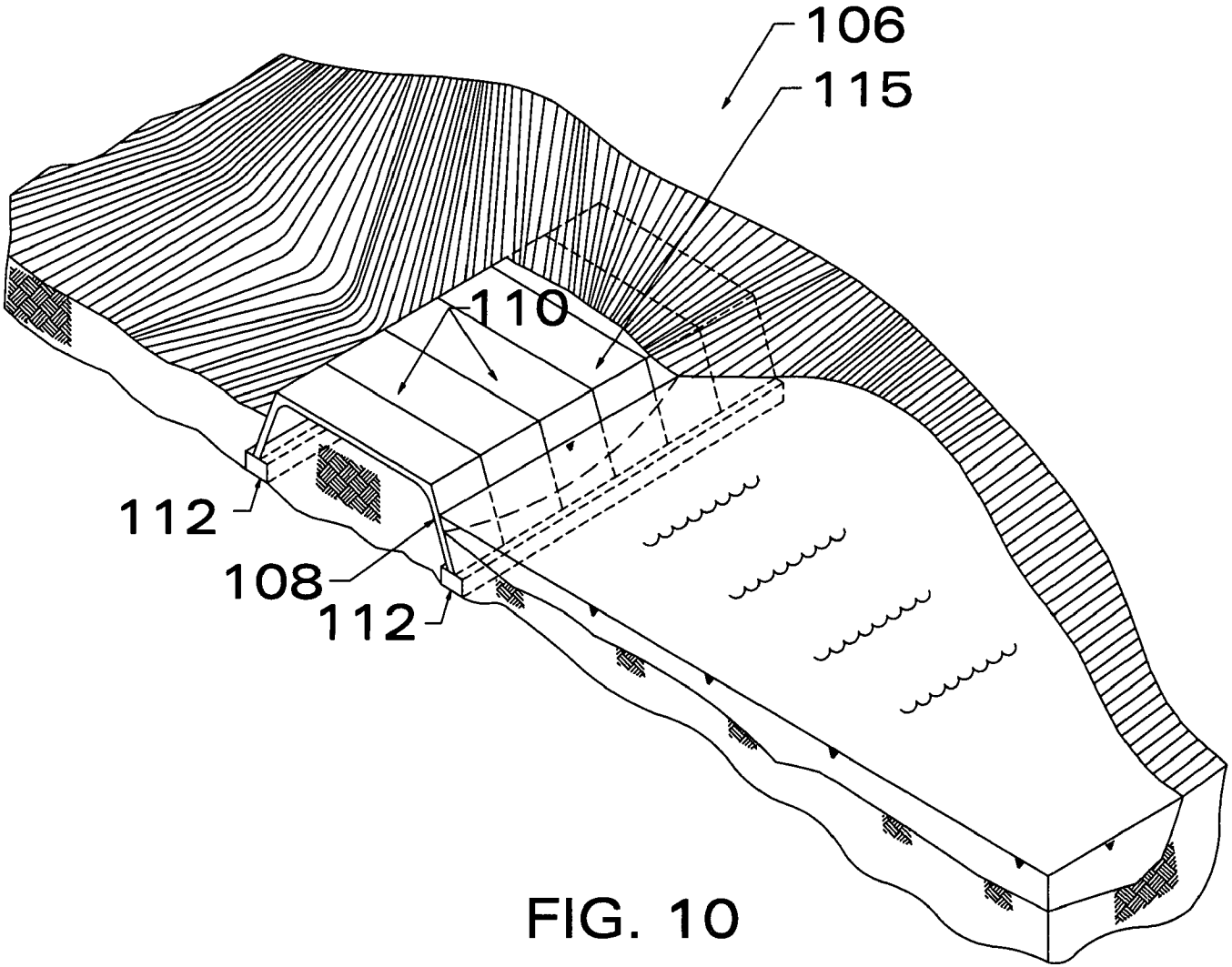
FIG. 10 is a perspective view of a segment of the present invention bridge system adapted for use in a dam and land bridge application with a portion of the surrounding water and soil cut away.
Figure 11:
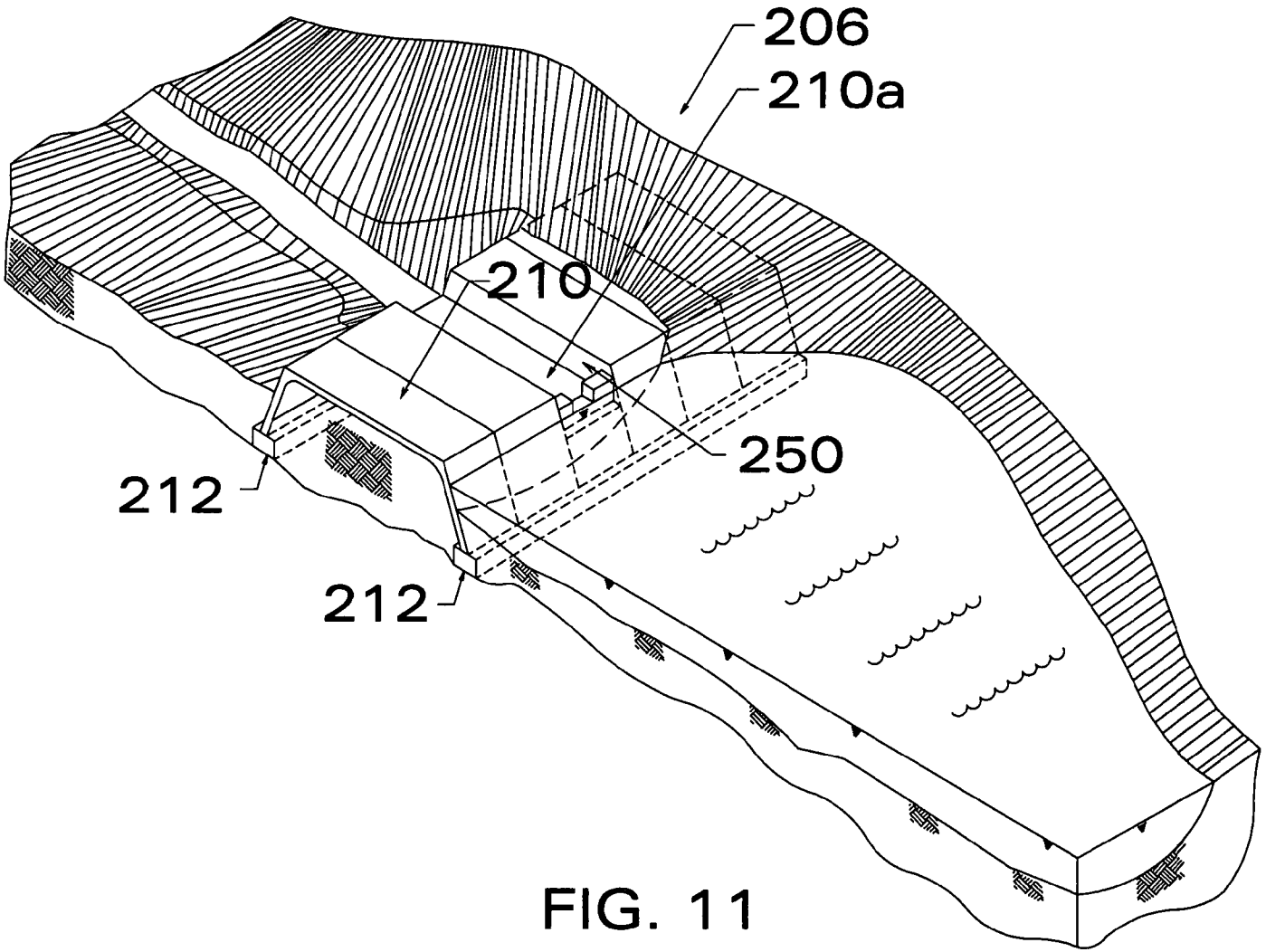
FIG. 11 is a perspective view of a segment of the present invention bridge system adapted for use as a flow control structure including a precast spillway and cast-in-place weir with a portion of the surrounding water and soil cut away.

The flared leg elemental sections of the present invention also can be installed to impound water as a dam or flow control structure. The use of the elemental sections in these applications is shown in FIGS. 10 and 11. FIG. 10 depicts a dam assembly 106 of precast flared leg sections. As shown in these diagrams, cast-in-place concrete strip footers 112 are cast in trenches in the ground and the flared leg sections 108 of the present invention are installed on top of the footers. One or more layers of fill (not shown) are placed underneath the top slabs 115 of sections 110 before or after the sections are installed. The fill is placed within the one or more precast concrete sections to roughly approximate the inner surfaces of the flared legs and the top slab. The sections are then sealed. To achieve barrier integrity, the interior portions of the sections 110 can be filled with impermeable compacted fill, lean concrete, flowable fill or many other materials. The completed assembly can also include steel, vinyl or concrete sheet pile installed prior to installation of the elemental sections as a water cut-off. The dam assembly of sections can be provided with through-dam components for flow metering or emergency draw-down. Additionally, the dam assembly can include access ports to allow entry into the interior portion of the assembled sections for maintenance and inspection access to internal equipment.

FIG. 11 depicts an assembly 206 of precast flared leg sections forming a concrete spillway in conjunction with a cast-in-place or precast concrete weir. Flared leg sections 210 are installed on footers 212 as described above, but with one or more sections 210*a* having a shorter rise to create the spillway portion. Sections adjacent to these shorter rise sections have integrally attached closure walls 250 to meet up with the underside of the adjacent full-sized section and the weir would be placed on top of the spillway.

Dam or flow control structures comprising flared-leg precast sections can also be used as land bridges. The sections for this application would be manufactured with female keyways in both faces of each section that would be grouted in-place after installation. The grouted keyways seal the spaces between the units against impounded water infiltration and provide a positive means of shear force transfer between units due to pedestrian and/or vehicular traffic on the top slab. As an added measure of security against water infiltration and for shear transfer between sections, the sections can be manufactured with ducts through which post-tensioning strands can be installed and tensioned after section installation.

While the flared-leg precast concrete bridge and dam systems herein described constitute preferred embodiments of the invention, it is to be understood that the invention is not limited to these precise embodiments, and that changes may be made therein without departing from the scope and spirit of the invention as defined in these claims. Those of ordinary skill in the art will appreciate that the invention can be carried out with various other minor modifications from that disclosed herein, and same is deemed to be within the scope of this invention.

We claim:

1. A concrete building system comprising:

a set of parallel spaced apart strip footers;

one or more precast concrete sections supported by the footers in predetermined alignment;

each precast concrete section having a top slab integrally connected to a pair of flared legs, the top slab having a uniform thickness, an inner surface, an upper surface, a first end and a second end, the distance between the first end and the second end defining an effective span;

each leg having a length, a uniform thickness, an inner surface, an outer surface, a top portion and a bottom portion, the bottom portion being supported by a footer and the distance between the bottom portions of the legs defining a bottom-of-leg span;

each leg depending from an end of the top slab at an effective flare angle to form a corner;

a pair of haunch sections;

each haunch section being integrally formed between the top slab and one of the legs whereby the haunch section extends from the inner surface of the top slab near an end to the inner surface of the top portion of the leg nearest that top slab end and results in a corner thickness greater than the uniform thickness of the top slab and the leg to which it is integrally formed;

a rise defined by the vertical distance between the bottom portion of the flared legs and the inner surface of the top slab; and the length of the effective span being between 60 and 90 percent of the bottom-of-leg span.

2. The concrete building system of claim 1 wherein the length of the effective span is between 75 and 85 percent of the bottom-of-leg span.

3. The concrete building system of claim 1 wherein the legs depend from the top slab at equal effective flare angles.

4. The concrete building system of claim 1 wherein the effective flare angle of one or more of the depending legs is between 55 and 85 degrees.

5. The concrete building system of claim 1 wherein the rise is between 6 and 14 feet.

6. The concrete building system of claim 1 wherein the bottom-of-leg span is between 12 and 48 feet.

7. The concrete building system of claim 1 wherein at least one of the pair of haunch sections comprises an arcuate inner surface having a radius.

8. The concrete building system of claim 7 wherein the radius is between 8 and 42 inches.

9. The concrete building system of claim 1 wherein the uniform thickness of the top slab is between 8 and 14 inches.

10. The concrete building system of claim 1 wherein the uniform thickness of each leg is between 8 and 14 inches.

11. The concrete building system of claim 1 wherein the concrete of the one or more of the precast concrete sections includes integral reinforcement.

12. The concrete building system of claim 11 wherein the integral reinforcement includes one or more of the following: steel reinforcing rods, mesh, embedded tendons or mixed-in steel fibers.

13. The concrete building system of claim 1 wherein the uniform thickness of the top slab is no greater than 8 inches, the uniform thickness of each leg is no greater than 8 inches, the bottom-of-leg span is at least 12 feet and the rise is at least 6 feet.

14. The concrete building system of claim 1 wherein the uniform thickness of the top slab is no greater than 12 inches, the uniform thickness of each leg is no greater than 12 inches, the bottom-of-leg span is at least 22 feet and the rise is at least 6 feet.

15. The concrete building system of claim 1 wherein the uniform thickness of the top slab is no greater than 14 inches, the uniform thickness of each leg is no greater than 14 inches, the bottom-of-leg span is at least 40 feet and the rise is at least 6 feet.

16. The concrete building system of claim 1 wherein one or more of the precast concrete sections has at least one leg with a bottom portion that includes an inwardly-angled integral leg extension.

17. The concrete building system of claim 1 wherein one of the legs of the one or more of the precast concrete sections has a length less than the length of the other leg.

18. The concrete building system of claim 1 wherein at least one of the one or more precast concrete sections further comprises an end wall.

19. The concrete building system of claim 1 further comprising one or more layers of impermeable fill placed within the one or more precast concrete sections to roughly approximate the inner surfaces of the flared legs and the top slab.

20. The concrete building system of claim 19 further comprising one or more water flow control devices.

21. The concrete building system of claim 20 wherein the one or more water flow control devices includes at least one or more of the following: a concrete spillway, a weir, a gate or a valve.

22. The concrete building system of claim 1 wherein one of the legs of the one or more of the precast concrete sections has a width less than the width of the other leg.

* * * * *